US008944168B2

(12) United States Patent
Pettigrew et al.

(10) Patent No.: US 8,944,168 B2
(45) Date of Patent: Feb. 3, 2015

(54) HIGH PRESSURE MULTISTAGE CENTRIFUGAL PUMP FOR FRACTURING HYDROCARBON RESERVES

(75) Inventors: Dana Pettigrew, Airdrie (CA); Wojciech A. Limanowka, Sherwood Park (CA); Zoran Vukadin, Edmonton (CA)

(73) Assignee: Nexen Energy ULC, Calgary, AB (CA)

( * ) Notice: Subject to any disclaimer, the term of this patent is extended or adjusted under 35 U.S.C. 154(b) by 456 days.

(21) Appl. No.: 13/353,353

(22) Filed: Jan. 19, 2012

(65) Prior Publication Data

US 2012/0205112 A1 Aug. 16, 2012

Related U.S. Application Data

(63) Continuation-in-part of application No. 13/328,245, filed on Dec. 16, 2011, now Pat. No. 8,763,704.

(60) Provisional application No. 61/434,167, filed on Jan. 19, 2011, provisional application No. 61/434,171, filed on Jan. 19, 2011.

(51) Int. Cl.

| | |
|---|---|
| ***E21B 43/26*** | (2006.01) |
| ***F04D 29/16*** | (2006.01) |
| ***F04D 1/06*** | (2006.01) |
| ***F04D 29/44*** | (2006.01) |

(52) U.S. Cl.

CPC ..... *F04D 29/165* (2013.01); *E21B 43/26* (2013.01); *F04D 1/063* (2013.01); *F04D 29/445* (2013.01)

USPC ..... 166/308.1; 166/54.1

(58) Field of Classification Search

USPC ..... 166/308.1, 54.1; 417/423.5; 416/211.2; 415/199.1–199.3, 214.1, 104

See application file for complete search history.

(56) References Cited

U.S. PATENT DOCUMENTS

| | | | | |
|---|---|---|---|---|
| 3,861,825 | A | 1/1975 | Blom | |
| 5,232,342 | A | 8/1993 | Thompson | |
| 6,960,330 | B1 | 11/2005 | Cox, Jr. | |
| 7,575,052 | B2 | 8/2009 | Sandberg et al. | |
| 2005/0098504 | A1 | 5/2005 | Manz et al. | |
| 2010/0022436 | A1 | 1/2010 | Durant et al. | |
| 2010/0272595 | A1 | 10/2010 | Maziasz et al. | |
| 2012/0160502 | A1 * | 6/2012 | Pettigrew | 166/308.3 |

OTHER PUBLICATIONS

Johnson, Elizabeth, "Water Research 2009", Ministry of Energy, Mines and Petroleum Resources, Resource Development and Geoscience Branch, 17 pages, 2009.

Pond, J., et al., "Horn River Frac Water: Past, Present, and Future" (Abstract), Canadian Society for Unconventional Gas, Society of Petroleum Engineers, 1 page, 2010.

* cited by examiner

*Primary Examiner* — Cathleen Hutchins
(74) *Attorney, Agent, or Firm* — Sheridan Ross P.C.

(57) ABSTRACT

The present invention relates to a multistage centrifugal pump design, which has the diffusers, impellors, and a shaft, inserted within a high pressure housing, such that this assembly is fully enclosed within the housing, and the housing is of sufficient strength to be suitable for safe pressure containment of the fluids being pumped. This invention describes the technical details used to reconfigure the multistage centrifugal pump design to increase the discharge pressure capabilities higher than the 6,000 psig of current designs.

12 Claims, 6 Drawing Sheets

HIGH PRESSURE MULTISTAGE CENTRIFUGAL PUMP FOR FRACTURING HYDROCARBON RESERVES

FIELD OF THE INVENTION

This invention relates in general to multistage centrifugal pumps for injecting fluids into a wellbore, which has been drilled into reservoir rock formations, and in particular to multistage centrifugal pumps injecting fluids into wells for purposes of fracturing said wells. In the oil and gas industry, which utilizes fracturing operations to stimulate oil and gas reservoirs, this operation requires high surface fluid treating pressures, which may be 10,000 psi.

BACKGROUND OF THE INVENTION

In oil and gas applications, fluids are frequently injected into a wellbore for a variety of different purposes and various types of surface pumps are employed. In prior art, a multistage centrifugal pump could be mounted horizontally, at the surface, adjacent to, or nearby the well requiring fluids to be injected into, and current designs have a maximum discharge pressure of 6,000 psi. This multistage centrifugal pump is one type of pump that is most often used in a vertical configuration within a wellbore for pumping fluid from the well to surface pipeline systems, as a production pump, and current designs have a maximum discharge pressure of 6,000 psi. In the oil and gas industry, which utilizes fracing operation to simulate Oil and Gas reservoirs, this operation requires high surface fluid treating pressures, which may be 10,000 psi. The present invention, a high pressure multistage centrifugal pump, has been designed to increase the operating discharge pressure from 6,000 psi to 10,000 psi to enable this pump to meet the above described application. This high discharge pressure capability could also be applied to other applications too.

The prior art multistage centrifugal pump is used in the Electric Submersible Pumping System ("ESPS") industry or in its surface Horizontal Pumping System ("HPS") application, which are limited to discharge pressure or differential pressure between internal and external pressure of the housing, to be below 6000 psi. The o-rings are commonly used as a sealing element between an intake and a pump base as well as between a discharge and a pump head. The diffusers contain the pressure generated in the pump stages and the pump housing is only used as secondary pressure containment since its primary role is to hold pump components together. The pump housing is sealed with o-rings on a pump base and a pump head. Diffusers are not designed to withstand high differential pressure between the outside and inside of the diffuser.

U.S. Pat. No. 3,861,825 teaches a multistage pump and manufacturing method. It describes the split-casing style of centrifugal pump. The pump speed is listed as approximately 12,500 rpm, with a discharge pressure that may be 2600 psi, with a suction pressure of 15 to 30 psi. They do reference previous patents, and then list some patents that have similarities.

The pump Nexen has disclosed herein is a housing type of centrifugal pump, operating at speeds of 30 to 90 hz, (1800 to 5400 rpm), with discharge pressures that may be 10,000 psi, and with a suction pressure that may be 15 to 600 psi. Any similarities would be with respect to centrifugal pumps in general, and the fact that they are composed of multiple stages.

U.S. Pat. No. 5,232,342 teaches high pressure multi-stage centrifugal pumps. It describes the split-casing style of centrifugal pump. That invention relates to means for preventing rotation of an interstage bushing or ring, as the main objective. There is no reference in this patent as to the discharge pressure capabilities to go along with the "High Pressure" referenced in the heading.

The pump Nexen has disclosed herein is a housing type of centrifugal pump, which is designed for operating at speeds of 30 to 90 hz, (1800 to 5400 rpm), with discharge pressures that may be 10,000 psi, and with a suction pressure that may be 15 to 600 psi.

The main difference here is we are using a housing type of centrifugal pump and are building it with many more stages than what has been done in the past. The pressure capability far exceeds current design standards (6,000 psi maximum listed by other manufactures such as Reda, Centrilift, Woodgroup, Weatherford, Canadian Advanced Inc.). Canadian Advanced ESP Inc. ("CAI") states in their HPS brochure that the HPS Design Capacities are maximally 4600 psi. CAI used special construction techniques to meet Nexen design and specification requirements to accommodate the high discharge pressure capabilities of 10,000 psi heretofore unknown.

With these ends in mind the main objective of the present invention is to provide details on pump construction that was used to expand the multistage housing centrifugal pump to enable it to operate at a very high discharge pressure of 10,000 psi. The high pressure is contained by the housing, which the diffusers are inserted into. High pressure is controlled through the use of seals on the external of the diffusers to prevent cross flow to other diffusers. Openings in external wall of diffusers are used to provide rapid release of pressure trapped between the diffusers and the housing to prevent diffuser collapse when a unit is shut-down and depressurized. One skilled in the art would appreciate the modifications provided in the present invention to achieve its objectives i.e. sufficient pressure control and pressure relief for the diffuser as required. This pressure release could be accomplished by slots, holes and other openings.

Special threading on the discharge ends of housings is required to support high pressure pipe connections.

It is yet another object of the invention to provide a multiple stage centrifugal pump for fracturing hydrocarbon deposits that is capable of generating in excess of 10,000 psi.

It is a further object of the invention to provide said pump designed to equalize pressures in the housing of said pump from stage to stage.

It is another object of the invention to provide said multiple stage centrifugal fracturing pump with construction materials in alignment with the well known recommendations published for material performance criteria from for example, NACE (National Association of Corrosion Engineers), ASTME (American Society of Tool and Manufacturing Engineers) or ANSI (American National Standards Institute) trim packaging or the like in view of the corrosive nature of the fluids being pumped.

It is another object of the invention to provide said pump with the preferred NACE trim packaging or the like in view of the corrosive nature of the fluids being pumped.

It is yet another object of the invention to provide a multiple stage high pressure centrifugal pump capable of use in fracturing a hydrocarbon reserve while avoiding treating the aquifer water prior to using it for hydrocarbon fracturing as a result of the high pressure capabilities of said pump.

It is a further object of the invention to enable the use of non-potable underground aquifer water, such as the Debolt formation aquifer, as a source of water for the fracturing of underground rock formations containing hydrocarbon reserves.

Further and other objects of the invention will be apparent to one skilled in the art when considering the following summary of the invention and the more detailed description of the preferred embodiments described and illustrated herein along with the appended claims.

SUMMARY OF THE INVENTION

In this invention, a multistage centrifugal pump is built to be capable to deliver discharge pressure or differential pressure between pump internal and external pressures of up to substantially 10,000 psi or more. A pump housing is designed to be the primary pressure containment. The sealing interface between the pump base and pump head is a metal on metal type achieved by using specialized thread. The diffusers are designed with openings to allow rapid pressure equalization across the diffuser outside edge to avoid failure from high differential pressure which could cause diffuser failure. A seal is used on the outside of the diffusers to prevent pressure communication, and fluid flow, between the outside of the individual diffusers enclosed within the housing. The pump connections to pump intake and discharge are upgraded to ring or gasket style sealing.

The present invention also relates to a multistage centrifugal pump design, which has the diffusers, impellers, and a shaft, inserted within a high pressure housing wherein this assembly is fully enclosed within the housing, and the housing is of sufficient strength to be suitable for safe pressure containment of the fluids being pumped. This invention describes the technical details used to reconfigure a known multistage centrifugal pump design to enable increase of the discharge pressure capabilities higher than the 6,000 psi of current designs. The design modifications discussed herein have been successfully tested at 10,000 psi discharge pressure. The 10,000 psi pressure capability provides a pressure suitable for fracturing hydrocarbon formations penetrated by wellbores.

This style of pump unit is well suited to the hydrocarbon fracturing industry to pump fluids at sufficient pressures, to stimulate underground rock formations containing hydrocarbon reserves.

The invention is preferably a housing type of centrifugal pump, which is designed for operating at speeds of 30 to 90 hz, (1800 to 5400 rpm), with discharge pressures that may be 10,000 psi, and with a suction pressure that may be 15 to 600 psi.

Preferably said pump includes a pressure sleeve (21) on top of diffuser (14) wall for improved wall strength by compression fit between sleeve (21) and outside diameter of diffuser (14) wall (FIGS. 3 and 4).

Also preferably said pump utilizes an equalization hole (23) in the diffuser wall, resulting in zero differential pressure across diffuser wall and also allows for rapid depressurizing (FIGS. 3 and 4).

Preferably to prevent stages from collapsing due to pressure transfer from one pump stage to another, o-ring (31) style sealing is utilized between each diffuser (14) and housing (16) (FIG. 3).

In one embodiment sealing between pump housing (16) and both pump base (12) and pump head (19) is by specialized threads providing metal on metal sealing, eliminating all elastomeric and non-elastomeric seals through the use of proven metal-to metal thread sealing technology such as base-head pin-housing connection (FIG. 2).

The multistage centrifugal pump is designed for injecting fluids into a wellbore for purpose of fracturing this well.

According to a primary aspect of the invention there is provided a multiple stage centrifugal pump for fracturing hydrocarbon deposits capable to deliver discharge pressure or differential pressure between the pump internal and external pressure to be in the range of greater than 6,000 psi to up to substantially 10,000 psi or over, said pump comprising;

a pump housing designed for primary pressure containment, a seal between the pump base and pump head being metal on metal type achieved by using specialized thread, diffusers designed with openings to allow rapid pressure equalization across the diffuser outside edge to avoid failure from high differential pressure which could cause diffuser failure, a seal used on the outside of the diffusers to prevent pressure communication, and fluid flow, between the outside of the individual diffusers enclosed within the housing and the pump connections to the pump intake and discharge including upgrades to ring or gasket style sealing. wherein said pump design delivers a discharge pressure or differential pressure between the pump internal and external pressure in the range of greater than 6,000 psi to 10,000 psi or higher, which is substantially much higher pressures then the previously 6,000 psi maximum limit.

Preferably the multistage centrifugal pump further comprises diffusers, impellers, and a shaft, inserted within a high pressure housing, the assembly being fully enclosed within the housing, and the housing being of sufficient strength to be suitable for safe pressure containment of the fluids being pumped.

Another embodiment utilizes a pressure sleeve (21) on top of the diffuser (14) wall for improved wall strength by compression fit between the sleeve (21) and the outside diameter of the diffuser (14) wall (FIGS. 3 and 4).

Yet another embodiment utilizes equalizations openings (23) in the diffuser wall, resulting in zero differential pressure across the diffuser wall which also allows for rapid depressurizing (FIG. 2).

Preferably to prevent stages from collapsing due to pressure transfer from one pump stage to another o-ring (31) style sealing is utilized between each diffuser (14) and housing (16) (FIG. 3).

More preferably the sealing between the pump housing (16) and both the pump base (12) and the pump head (19) is by specialized threads providing metal on metal sealing, thereby eliminating all elastomeric and non-elastomeric seals through the use of proven metal-to metal thread sealing technology (base-head pin-housing connection see FIG. 2).

According to yet another aspect of the invention there is provided the use of the pump described herein and above for a multi-stage centrifugal pump to provide mechanical and hydraulic pressure capability for this High Pressure multi-stage centrifugal pump to operate at a range of greater than 6,000 psi to up to substantially 10,000 psi or more discharge pressures for injecting fluids to a wellbore for the purpose of hydraulic fracturing of wells in hydrocarbon deposits.

The Debolt subsurface formation or zone in north east British Columbia is an aquifer whose water contains approximately 22,000 ppm of total dissolved solids ("TDS") and a small amount of hydrogen sulphide—$H_2S$. The scope and volume of the Debolt formation is still being investigated, but it has the potential to be extensive. This aquifer has high permeability and porosity. A Debolt well at b-H18-I/94-O-8 was tested in May, 2010, with a 10.25" 900 HP downhole electrical submersible pump ("ESP"). The well showed a Productivity Index of 107 m3/d per 1 kPa drawdown, indicating that the reservoir will provide a high enough rate of flow to support the volume and rate requirements needed to support well fracturing operations.

Debolt formation water contains sour gas in solution. When depressurized to atmospheric conditions, the Debolt water flashed off sour gas at a gas water ratio of 1.35 standard $m^3$ of gas to 1 $m^3$ of water. The flashed gas contained 0.5% $H_2S$ (hydrogen sulphide), 42% $CO_2$ (carbon dioxide) and 57% $CH_4$ (methane). These gases are the same gases present in shale gas production wells, which are normally in the range of 0.0005% $H_2S$, 9% $CO_2$, and 91% $CH_4$, and the use of raw Debolt water would have a negligible impact on the current percentage of shale gas components.

The challenge is how to use sour water, for example Debolt water, for fracing in a cost effective manner since current water fracturing equipment does not comply with the well known recommendations published for material performance criteria from for example NACE, ASTME or ANSI standards for sour trim packaging or the like.

There are two different ways of using Debolt formation water for fracturing operations. The first is to construct and operate a water treatment plant to remove the $H_2$5 from Debolt water. This approach has been taken by other industry participants who have constructed an $H_2S$ stripping plant to remove the $H_2S$ from Debolt water. A recent paper published by Canadian Society for Unconventional Resources entitled "Horn River Frac Water: Past, Present, Future" discusses the technical and operational aspects of the Debolt Water Treatment Plant constructed and operated for the foregoing purposes. This paper states that a very expensive treatment plant is required to remove the $H_2S$ and other solution gases from the Debolt water.

The second approach is to maintain the aquifer water at a pressure above its saturation pressure (also known as the "Bubble Point Pressure" or "BPP") on a continuous basis while being produced to surface and transported in pipelines to enable it to be used for fracturing. Tests conducted on the Debolt water properties indicates that as long as the Debolt water is maintained at a pressure high enough to keep the solution gas entrained in the water, the water is stable with no precipitates, and remains crystal clear in colour. Further, as long as the Debolt water is kept above its BPP, then the water is in the least corrosive state. These findings reveal that the Debolt aquifer fluid can be used in its natural state requiring no treatment. This is the basis of the proprietary Pressurized-Frac-on-Demand ("PFOD") process.

A primary aspect of this invention is therefore to provide a method or process of fracturing a hydrocarbon deposit on demand comprising the steps of:

using as a source of water an underground aquifer which contains water which is stable and clear in the aquifer but which may include undesirable constituents that are in solution when subjected to surface conditions such as hydrogen sulfide and other constituents, utilizing the water from the aquifer as a source of water to be used in a hydrocarbon fracturing process and to pump the water under pressure at a predetermined rate for the aquifer water and above the bubble point pressure (BPP) for the water contained in a particular aquifer to keep the water stable. We have found that the water becomes unstable when the pressure is reduced and gas is allowed to evolve out of the water. This depressuring and gas removal initiates a chemical reaction with the dissolved solids in the water to cause precipitates to form. To prevent these chemical reactions from occurring and causing the undesirable constituents of said water from falling out of solution, maintaining said water pressure at a minimum required for each aquifer at all times during the fracturing process, drilling a source well into the aquifer, drilling a disposal well to the aquifer, providing a pump capable of maintaining the required pressure needed to prevent the constituents of the aquifer water from coming out of solution only by maintaining the minimum pressure, establishing a closed loop with a manifold, or a manifold and pumps, to keep the aquifer water circulating at all times until the fracturing operation begins when water will be supplied from that manifold, providing the fracturing operation with water from the manifold so as to fracture a hydrocarbon reserve, wherein in using water from an aquifer in the fracturing process and by maintaining said water under pressure at a minimum at all times, said water remains stable and the undesirable constituents remain in solution and the water remains clear thereby avoiding the necessity of treating the water from the aquifer prior to using it in a fracturing processes.

According to another aspect of the invention there is provided a method or process of high-pressure fracturing of a hydrocarbon deposit, for example a shale gas deposit on demand comprising the steps of using as a source of water from an underground aquifer such as the Debolt aquifer which contains sour water including $H_2S$ and other constituents, utilizing the sour water from the aquifer as the water source to be used preferably on at least the clean side of a gas fracturing process and to pump said sour water under pressure at a minimum of for example 2310 kPa for Debolt water at approximately 38 degrees Celsius (which varies with the actual temperature of source water for each aquifer, and any surface cooling which may occur to such water) and above the BPP for the sour water contained in a particular aquifer to prevent $H_2S$ and other constituents of said sour water from falling out of solution, maintaining said sour water pressure at a minimum required for each aquifer, for example for Debolt of 2310 kPa at all times during the fracturing process, drilling a source well into the aquifer, drilling a disposal well into the aquifer, providing a pump capable of maintaining the required pressure needed to prevent the constituents of the sour water from coming out of solution only by maintaining the minimum pressure required which, for example, for Debolt water is 2310 kPa at 38 degrees Celsius, establishing a closed loop with a manifold to keep the sour water circulating at all times until the well fracturing operation begins when water will be supplied from that manifold, or a manifold and pumps, providing the clean side of a well fracturing operation with sour water from the manifold so as to fracture a well reserve (normally an oil or gas zone reserve), wherein in using sour water from an aquifer such as Debolt for the well fracturing process and maintaining said sour water under pressure at a minimum, as an example for Debolt water being at 2310 kPa and 38 degrees Celsius, said water remains stable and the constituents remain in solution and the water remains clear thereby avoiding the necessity of stripping out the hydrogen sulfide and other constituents as is required by other well fracturing processes.

In one embodiment of the invention said water source and method or process is utilized along with sand on the dirty side of the well fracturing operation with the addition of a high-pressure blender since the sour water must be maintained above its BPP, for example 2310 kPa for Debolt water at 38 degrees Celsius at all times thereby avoiding the constituents including the $H_2S$ from falling out of solution.

In a further embodiment of the method or process the necessary number of pumps and source wells and disposal water wells are provided with the method or process to enable a high-pressure fracturing operation on demand for a target number of fracs (which depends on the particular well design chosen for a reservoir stimulation or other purpose) for each well, or number of wells, stimulated as part of a program.

Preferably in the method or the process said water from the source aquifer is at an elevated temperature (as compared to surface water temperatures), for example for Debolt water a temperature under normal circumstances has been 38 degrees Celsius, which therefore requires no additional heating, or insulated piping, and which may be used as a source of sour water for the pressurized fracturing on demand process even during the colder winter months experienced in, for example, Western Canada or similar areas and which can contribute considerable cost savings when compared to utilizing surface water.

In yet another embodiment the method or process utilizes sour water from the Debolt aquifer and continuously circulates said water at a pressure above the BPP from the source well to the disposal well in an underground pipeline system accomplished by a back pressure control valve located downstream of the well to be fractured near the Debolt water circulation line and yet upstream of the disposal wells wherein when water is required for frac operations, water will be withdrawn from a manifold strategically located on this circulation line thereby feeding Debolt water to the frac operation under pressure, which is above the Debolt BPP.

According to yet another embodiment of the method or process the Debolt water is maintained at a pressure above its saturation pressure ("BPP") and is continuously used for fracing so that as long as the Debolt water is maintained at a high enough pressure to keep the solution gas entrained in the water, then the water remains stable, with no precipitates and is in the least corrosive state thus requiring that all frac operations (at least on the clean side) be conducted at pressures above the Debolt water BPP which is the basis for a successful PFOD process.

In yet another embodiment the method or process further comprises a NACE trim, preferably a High Pressure Horizontal Pumping System ("HPHPS") frac pump capable of providing a discharge pressure of about 69 MPa. The pump construction uses materials in alignment with the recommendations published by the National Association of Corrosion Engineers ("NACE") trim packaging in view of the corrosive nature of the fluids being pumped). Alternatively, materials may be selected from material performance criteria for a HPHPS frac pump or equivalent published by for example ASTME, ANSI or the like. Alternatively, other suitable pump construction materials can be tested specifically for the fluid to pumped to ensure suitable material compatibility is maintained.

In order to carry out the process of this invention, a multistage centrifugal pump is built capable of delivering a discharge pressure or differential pressure between pump internal and external pressures to over 10,000 psi. A pump housing is designed to be the primary pressure containment. The sealing interface between the pump base and pump head is a metal on metal type achieved by using specialized thread. The diffusers are designed with openings to allow rapid pressure equalization across the diffuser outside edge to avoid failure from high differential pressure which could cause diffuser failure. A seal is used on the outside of the diffusers to prevent pressure communication, and fluid flow, between the outside of the individual diffusers enclosed within the housing. The pump connections to pump intake and discharge are upgraded to ring or gasket style sealing.

The present invention also relates to a multistage centrifugal pump design, which has the diffusers, impellers, and a shaft, inserted within a high pressure housing, wherein this assembly is fully enclosed within the housing, and the housing is of sufficient strength to be suitable for safe pressure containment of the fluids being pumped. This aspect of the invention describes the technical details used to reconfigure the known multistage centrifugal pump design to enable increase of the discharge pressure capabilities higher than the 6,000 psi of current designs. The design modifications discussed herein have been successfully tested at 10,000 psi discharge pressure. The 10,000 psi pressure capability provides a pressure suitable for fracturing formations penetrated by wellbores.

This style of pump unit is well suited to the hydrocarbon fracturing industry to be used to pump fluids at sufficient pressures, to stimulate oil and gas reservoirs.

The invention is a housing type of centrifugal pump, which is designed for operating at speeds of 30 to 90 hz, (1800 to 5400 rpm), with discharge pressures that may be 10,000 psi, and with a suction pressure that may be 15 to 600 psi.

Preferably said pump is utilizing pressure sleeve (21) on top of diffuser (14) wall for improved wall strength by compression fit between sleeve (21) and outside diameter of diffuser (14) wall (FIGS. 3 and 4).

Also preferably said pump is utilizing equalizations hole (23) in diffuser wall, resulting in zero differential pressure across diffuser wall and also allows for rapid depressurizing (FIG. 2).

Preferably to prevent stages from collapsing due to pressure transfer from one pump stage to another o-ring (31) style sealing is utilized between each diffuser (14) and housing (16) (FIG. 3).

In one embodiment sealing between pump housing (16) and both pump base (12) and pump head (19) is by specialized threads providing metal on metal sealing, eliminating all elastomeric and non-elastomeric seals through the use of proven metal to metal thread sealing technology such as base-head pin-housing connection (FIG. 2).

The multistage centrifugal pump is designed for injecting fluids into a wellbore for purpose of fracturing this well.

According to that aspect of the invention there is provided a multiple stage centrifugal pump for fracturing hydrocarbon deposits capable to deliver discharge pressure or differential pressure between the pump internal and external pressure to be over 10,000 psi and including a pump housing designed for the primary pressure containment, sealing between the pump base and pump head is metal on metal type achieved by using specialized thread, diffusers are included designed with openings to allow rapid pressure equalization across the diffuser outside edge to avoid failure from high differential pressure which could cause diffuser failure, a seal is used on the outside of the diffusers to prevent pressure communication, and fluid flow, between the outside of the individual diffusers enclosed within the housing and the pump connections to pump intake and discharge are upgraded to ring or gasket style sealing.

DETAILED DESCRIPTION OF THE PREFERRED EMBODIMENTS

Figure 1:
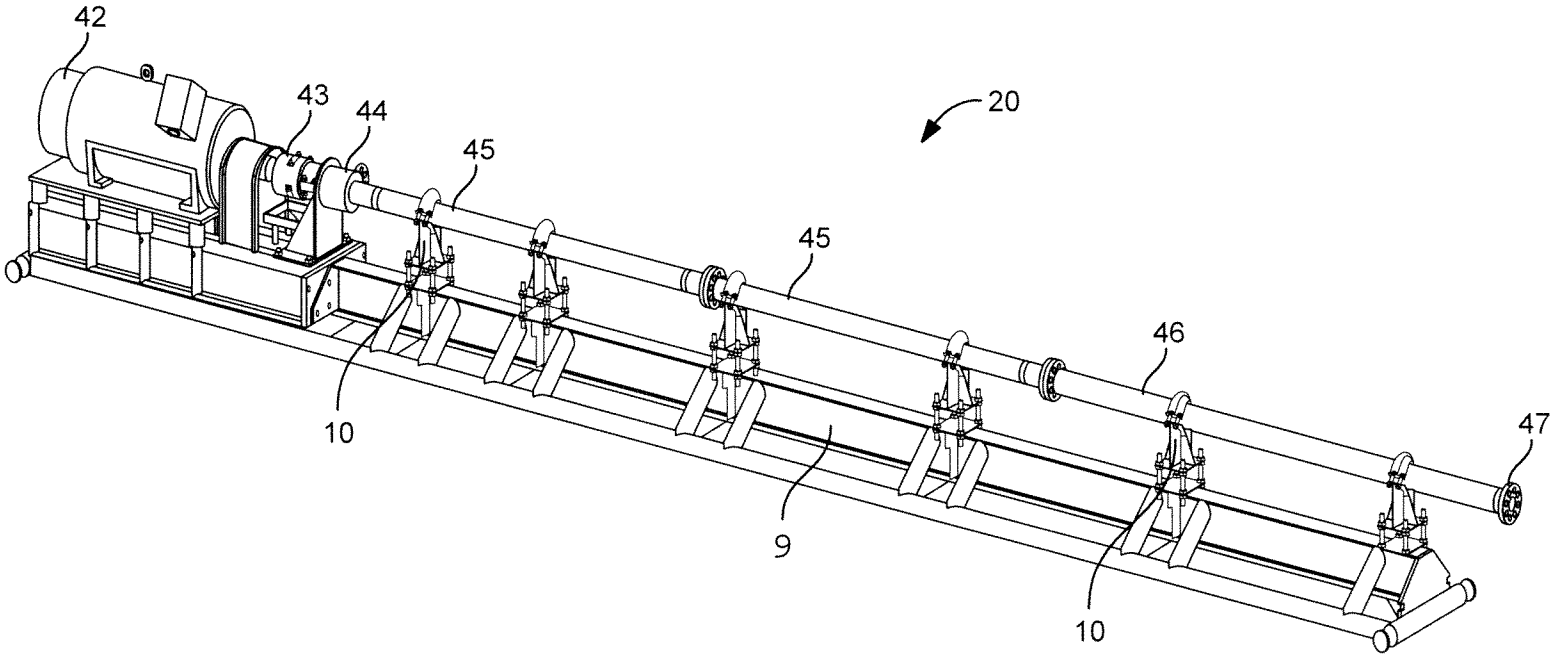
FIG. 1 is a perspective view (an isometric view) of high pressure multistage centrifugal pump unit constructed in accordance with the present invention.

Over the past two years, Nexen has been working on the PFOD process as outlined below, using Debolt water above its BPP for fracing thus eliminating the need for an expensive $H_2S$ removal process.

In order to guarantee a reliable source of water for its fracturing operations, it was necessary to identify ways to utilize the Debolt water as part of the frac water source. One of the options reviewed was to use Debolt water for only the clean side of the frac program.

In light of its requirements, Nexen designed and built a small flow high pressure multistage centrifugal pump for testing. In June 2010, a 0.25 $m^3$/min NACE trim high pressure multistage centrifugal test pump capable of providing a discharge pressure of 69 MPa was tested on the b-18-I pad in northeast British Columbia. Technicians were onsite to operate the Debolt water source well ("WSW") ESP and the high pressure multistage centrifugal test pump. Three chokes consisting of two bean types and one variable choke were piped up in series to provide the back pressure to test the high pressure multistage centrifugal pump at fracturing pressure.

In the initial tests, the high pressure multistage centrifugal test pump used freshwater from a tank truck. All the pump control parameters were set. In subsequent tests, Debolt water was used and fed by the Debolt WSW at b-H18-I/94-O-8 by ESP to the suction of the high pressure multistage centrifugal test pump. The discharge from the test pump flowed through three chokes at various back pressures. The Debolt water then exited the chokes and flowed into a disposal water pipeline to the water disposal well ("WDW") at b-16-I. The back pressure was progressively increased at 7000 kPa intervals and ran at that discharge pressure for approximately 30 to 60 minutes. When pump operations remained steady, the choke was adjusted to increase the discharge pressure of the pump.

The high pressure multistage centrifugal test pump was successfully tested on Jul. 7 and 8, 2010. It operated at a maximum discharge pressure of 71 MPa. The pump was run using Debolt water for approximately 6 hours at 62 MPa to simulate a complete fracturing operation.

It is understood that other aquifers will have different physical parameters. For example, pump specifications will reflect different BPP for alternative water sources. For the Debolt water source, the BPP of the aquifer water was 2310 kPag at 38 degrees Celsius.

In August 2010 during the completion of the 8 wells at pad b-18-I, the high pressure multistage centrifugal test pump was integrated into 6 fracturing operations. Three of the 6 fracs ran using freshwater and 3 ran using Debolt water. The high pressure multistage centrifugal test pump ran well for all 6 fracs and there were no operational or safety issues encountered.

Only one source water well and one disposal well are required for the initial testing of the PFOD system, and additional wells will provide increased capacity and backup to ensure minimum flow rate and injection capacities are available as required for the system to operate reliably with maximum system availability and use. Nexen is planning to drill and complete additional Debolt formation WSWs and additional Debolt WDW in the future as required to optimize the Debolt water system to support fracturing operations. Together with the existing b-H18-I Debolt WSW and the existing Debolt WDW b-16-I, these 2 initial wells plus any additional wells will form the basis of the PFOD water circulation system identified for such well fracturing program.

Nexen will continue to further evaluate the need to source and test a 1.25 m3/min full size 3000 kPa suction pressure for a sour trim plunger frac pump for the dirty side based on the well known recommendations published for material performance criteria from for example, NACE, ASTME or ANSI trim packaging or the like. This also includes the evaluation of the need for a pressurized blender, or another method for utilizing Debolt water for the dirty side.

Based on the Debolt water well tests conducted in June 2010, a feasibility study of the PFOD process, and initial field testing of a prototype NACE sour trim high pressure multistage centrifugal frac pump in July and August of 2010, it was concluded:

- It is technically and economically feasible to use Debolt water in its untreated state for fracturing operations.
- It is possible using the PFOD process to maintain pressures above 2310 kPa (BPP for Debolt water) thus keeping gases including $H_2S$ contained in solution.
- No water compatibility issues have arisen using Debolt water for fracturing or injection into underground hydrocarbon shale reservoirs.
- A high pressure multistage centrifugal sour trim frac pump using Debolt water can be constructed and used on the clean side of fracturing operations.
- No operational or safety issues were identified during the testing and ultimate use in the field of the high pressure multistage centrifugal pump.
- Freshwater may not be readily available for operations. Water from Debolt using PFOD process is readily available, and availability is not subject to spring and summer rainfall or suspension of licenses due to drought. For example, in August, 2010, government regulators in British Columbia suspended freshwater withdrawal licenses for hydrocarbon fracturing operations in the Montney area due to a drought in the Peace River watershed.
- There is experience in the pump industry in building a high suction pressure plunger style pump, with a NACE sour trim fluid end. There is no experience in the frac pump industry in building a high suction pressure (over 330 psi (2300 kpag)) plunger style frac pump, with a NACE trim fluid end, capable of pumping American Petroleum Institute ("API") quality frac sand for the dirty side fracing.
- There is no apparent technical limitation or constraint to prevent the engineering and fabrication of a pressure blender to use Debolt water under pressure.

Figure 5:
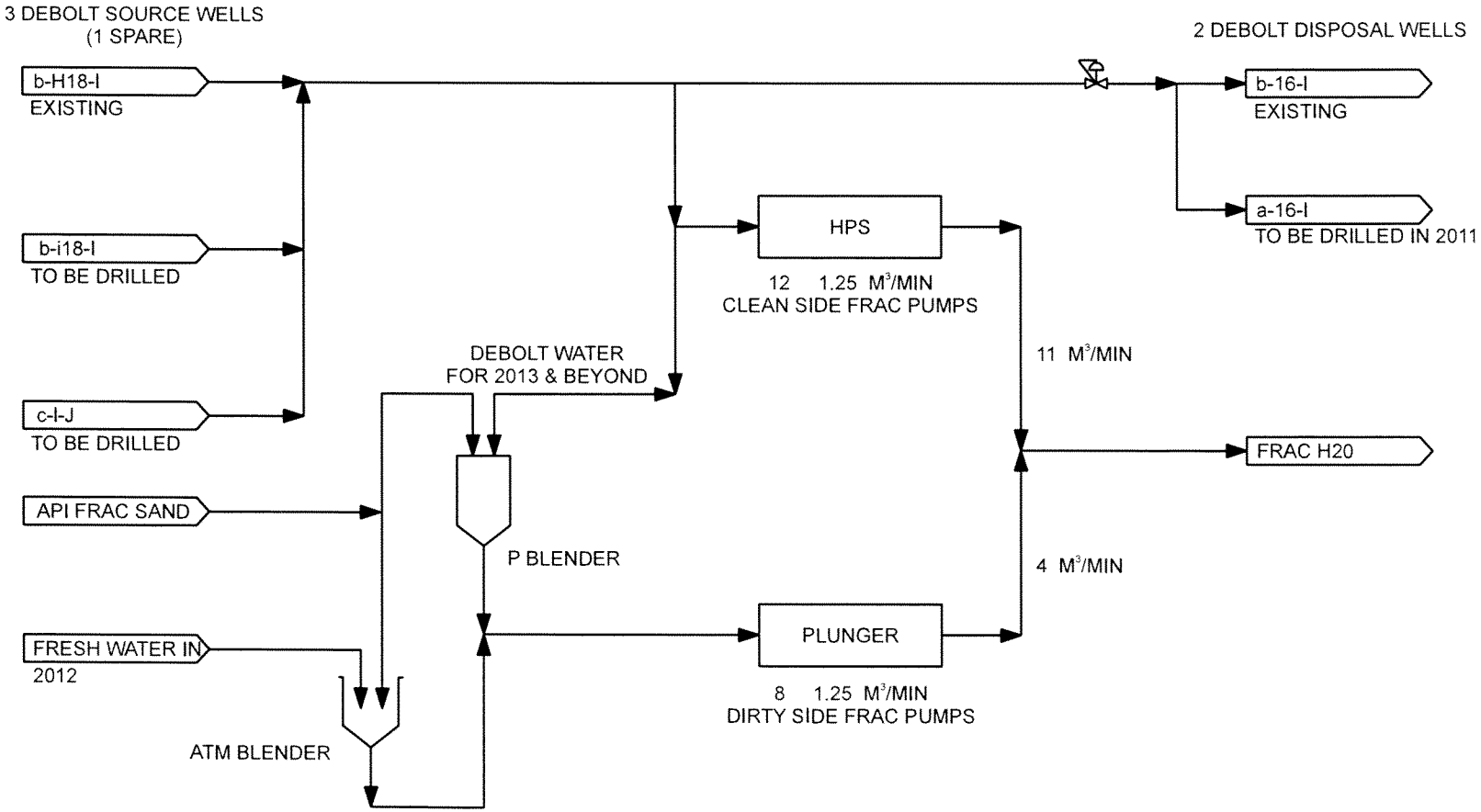
FIG. 5 is a PFOD Process Flow Schematic.
Figure 6:
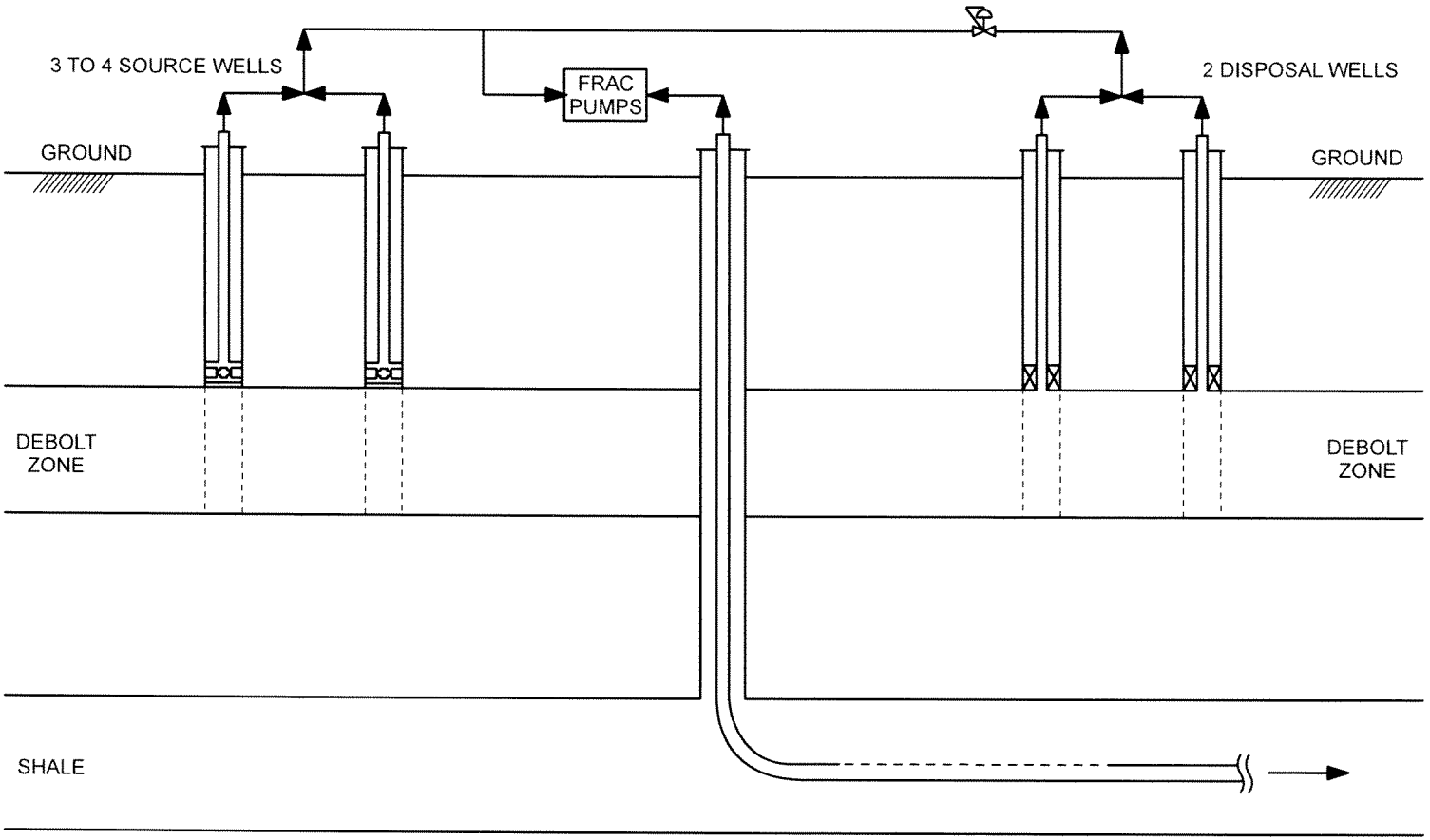
FIG. 6 is a PFOD Elevation View of FIG. 5.

The PFOD Process illustrated in FIGS. 5 and 6

The PFOD process maintains water at a pressure above its BPP at all times in order to prevent gases (including $H_2S$, $CO_2$ and $CH_4$) from coming out of solution. Based on Debolt well formation water and Pressure—Volume—Temperature ("PVT") tests, the Debolt water BPP is 2310 kPa (335 Psi) at 38 degrees Celsius. When the Debolt water at 38 degrees Celsius was de-pressurized to atmospheric pressure, approximately 1.35 $m^3$ gas was released per $m^3$ of water. The flashed gas contained 0.5% $H_2S$, 42% $CO_2$ and 57% $CH_4$ (methane). These are the same gases present in certain shale gas operations (normally 0.0005% $H_2S$, 9% $CO_2$, and 91% $CH_4$ (methane). The use of raw Debolt water would have negligible impact on the current percentage of shale gas components content.

For the typical PFOD system, 1 or more Debolt WSWs and 1 or more Debolt WDWs will be required. Debolt water will be continuously circulated at a pressure above the BPP from the WSWs to the WDWs utilizing a pressurized pipeline system. This will be accomplished by a back pressure control valve located downstream of the well to be fractured and near the water disposal well wherein when water is required for frac operations, water will be withdrawn from a manifold strategically located on this circulation line thereby feeding Debolt water to the frac operation under pressure, which is above the Debolt BPP. The two figures show a PFOD flow schematic and a subsurface elevation view. These figures demonstrate how the PFOD pipeline system would work.

The advantages of a PFOD process are numerous and include the following:

- Fracturing operations can to be conducted on a continuous basis year round. Debolt water is typically at 38 degrees Celsius. This allows for the use of Debolt water in the winter months without requirement for heating or the other infrastructure often required for winter frac operations including insulated pipelines for water circulation.
- Year round fracing capability will allow for production flexibility relative to commodity demand and pricing.
- The PFOD process eliminates the intensive capital and operation costs associated with building, operating and maintaining water treatment facilities.
- The PFOD process also reduces the need for secondary facilities that are required as development of fracturing operations occurs at greater distances from the water treatment and $H_2S$ removal plants.
- The PFOD process eliminates the need for above ground treated water storage tanks or large holding ponds that would ordinarily be required to heat the water for an above ground treatment process. The Debolt aquifer therefore acts as a natural storage tank with no surface facilities, heating or maintenance required.
- The Debolt aquifer could also be used as the main storage location of excess fresh water to be used later during a fracturing operations.

Referring to the drawings and in particular to FIG. 1 shown therein is a preferred embodiment of the high pressure multistage centrifugal of the present invention. Depending upon the design pressure required the assembly is composed of one or more multistage centrifugal pumps (45) of the preferred high pressure multistage centrifugal pump (46). Pump brackets (10) attaches pumps (45) & (46) to a base (9) which serves as a foundation for complete assembly. A motor (42) is attached to the pumps (45) through a thrust chamber assembly (43). The assembly (20) also has intake (44) & discharge (47) which are suitably rated pressure components that allow the pump assembly to mechanically connect to external piping while directing and controlling flow within said piping.

FIG. 1 illustrates a schematic view of the high pressure multistage centrifugal pump assembly describing and numbering all components used within the assembly including:

9 the pump support—skid frame

42 the pump driver—electric motor

43 the thrust chamber to support shaft load from pump

44 the pump intake section

45 the low pressure multistage centrifugal pump housings containing the diffusers, impellers and shaft. Two pump sections are shown.

46 the high pressure multistage centrifugal pump housing containing the diffusers, impellers and shaft. This is an inventive aspect that takes the pressure capability from 6,000 psi up to up to substantially 10,000 psi discharge pressure.

47 High pressure discharge head for 10,000 psi. This is another inventive aspect that takes the pressure capability from 6,000 psi to up to substantially 10,000 psi discharge pressure.

The high pressure multistage centrifugal pump (46) is an assembly of impellers (13) and diffusers (14). The impellers (13) are installed on pump shaft (15) and are rotating as part of the shaft, as the impellers are mechanically connected to the shaft. The diffusers (14) are fixed in the pump assembly by being compressed by compression bearing (18) in the pump housing (16) against the pump base (12.) In order to increase the pressure produced to 10,000 psi discharge pressure, a sufficient number of impellor and diffuser stages are stacked on each other to increase the head capability of one stage to create the pressure required of all stages combined.

Figure 2:
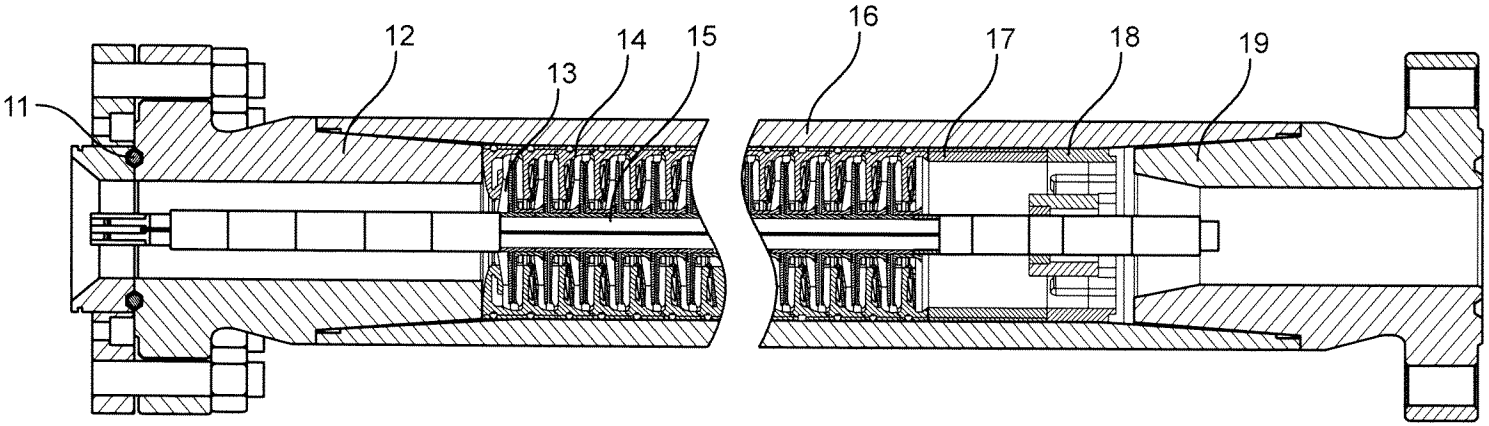
FIG. 2 is a sectional view of high pressure multistage centrifugal pump assembly illustrating components used within assembly.

FIG. 2 is a cross-section of the high pressure multistage centrifugal pump assembly of FIG. 1 describing all components used within the assembly including pump base (12) and pump head (19) threaded into pump housing (16). Each pump stage is an assembly of impeller (13) and diffuser (14). The impellers (13) are installed on pump shaft (15) and are the rotating part of the pump. The diffusers (14) are fixed in the pump assembly by being compressed by compression bearing (18) in the pump housing (16) and against pump base (12).

The sealing between pump housing (16) and both pump base (12) and pump head (19) is achieved by specialized threads such as API (American Petroleum Institute) or Hydril threads providing metal to metal seal capabilities under high differential pressure environments. High torque make up ensures strong connection capable of taking axial hydraulic load free of the leak. Each connection is also designed to withstand multiple make-ups and breaks without requiring redress.

Figure 3:
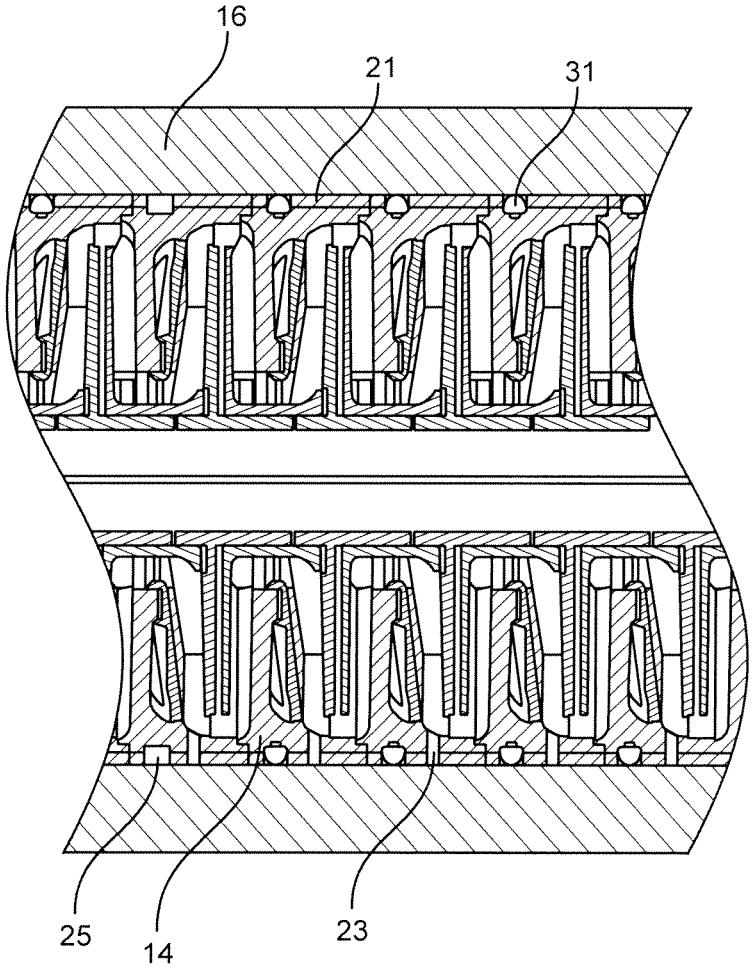
FIG. 3 is a sectional view of a portion of high pressure multistage centrifugal pump embodying the present invention.

Attention is next directed to FIG. 3 which shows a preferred embodiment of the invention. The high pressure multistage centrifugal pump (46) includes an outer high pressure housing (16) that holds and aligns all the components of the pump. The high pressure multistage centrifugal pump (46) includes diffusers (14) which are constructed with support sleeve (21) completely around the diffuser, which has grooves (25) and o-ring (31) the housing (16), and thereby provides a seal within said housing. When the pump is operating there is always some leakage into the annulus formed by the inside diameter of housing and outside diameter of the diffuser (14). When the annulus becomes full flow into it ceases as the pressure in the annulus equals the pressure at the source of the leak. If the source of the leak is at or near the discharge head of the pump, the annulus can be pressurized to full discharge pressure. To prevent this condition o-rings (31) are installed at every diffuser and equalization holes (23) are placed through diffuser wall so that maximum pressure is not limited by thin wall thickness of diffusers.

FIG. 3 is a cross-section illustration of FIG. 2 showing a number of impeller and diffuser stages in the high pressure multistage centrifugal pump housing (16). This invention includes the equalization hole (23) for rapid depressurizing, and the support sleeve (21) completely around the diffuser, which has grooves (25) to contain the o-ring (31) to prevent pressure communication, and fluid flow, between the outside of the individual diffusers enclosed within the housing. This high pressure housing (16) is designed to safely contain pressures up to 10,000 psi.

Figure 4:
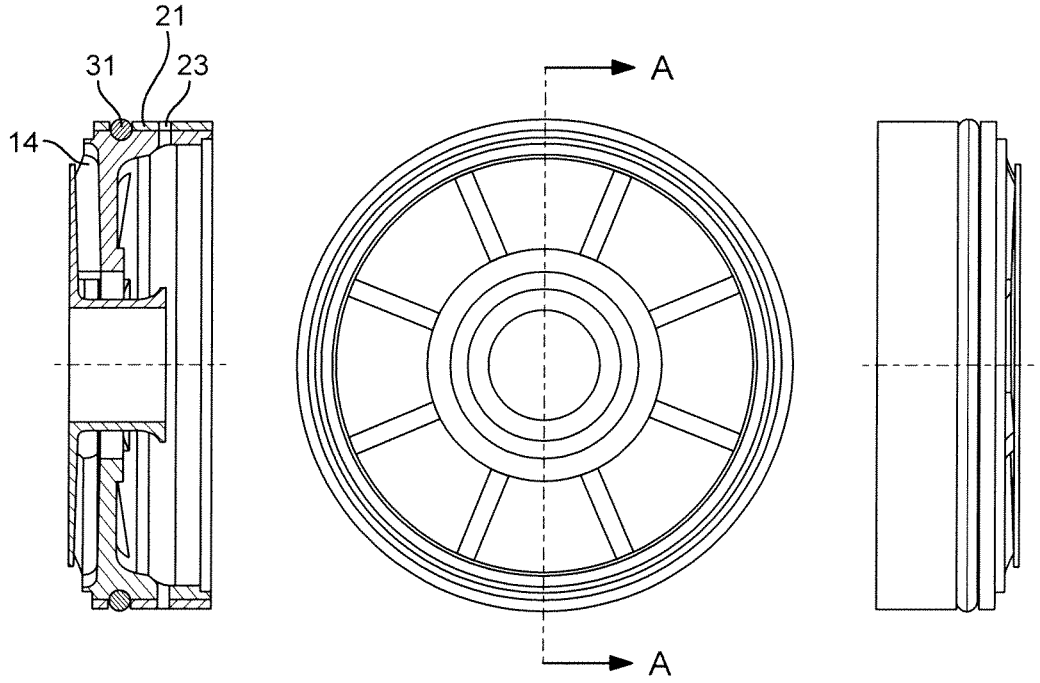
FIG. 4 is a sectional view of a diffuser for the high pressure multistage centrifugal pump embodying the present invention.

FIG. 4 illustrates in cross section the details of each diffuser (14), the support sleeve (21), the equalization hole (23), and the o-ring (31) for the high pressure multistage centrifugal pump assembly and the diffuser details showing compression sleeve (21) on top of diffuser (14). This invention includes the equalization hole (23) for rapid depressurizing, and the o-ring (31) to prevent pressure communication, and fluid flow, between the outside of the individual diffusers enclosed within the housing.

The present invention offers an economy of manufacture while affording maximum serviceability at the site of installation throughout the use of a high pressure multistage centrifugal pump. A presently preferred embodiment has been described for purposes of this disclosure.

The multistage high pressure centrifugal pump is to be built in such way that it eliminates high pressures across diffusers (14) wall by the provision of equalization openings (23) and sealing each diffuser in the housing, and improving diffuser wall strength (FIG. 2) wherein the pressure is contained by the pump housing (16) (FIG. 3).

The generic pump will contain pump base (12) and pump head (19) threaded into pump housing (16). A pump stage is an assembly of impeller (13) and diffuser (14). The impellers (13) are installed on pump shaft (15) and are the rotating part of the pump. The diffusers (14) are fixed in the pump assembly by being compressed by compression bearing (18) in the pump housing (16) and against pump base (12) (FIG. 2).

There are two options for improving the diffuser (14) wall strength:

1. utilizing increased wall thickness (improved wall strength) and tight (few thousandths of an inch) fit between the diffuser and the housing, thus preventing diffuser deformation.
2. As shown in FIG. 3 utilizing pressure sleeve (21) on top of diffuser wall (14) (improved wall strength by compression fit between sleeve and outside diameter of diffuser wall) and tight (few thousandths of an inch) fit between diffusers (14) and housing (16), thus preventing diffuser deformation.

Elimination of pressure gradient across the diffuser wall is achieved by drilling equalizations hole (23) in the diffuser wall resulting in zero differential pressure across diffuser wall (14). To eliminate a higher pressure from one stage to act on other diffusers, o-ring (31) style sealing is utilized between each diffuser (14) and housing (16), preventing pressure transfer, or fluid flow, on top of the diffusers (14) from one end of the pump housing to another. The primary pressure containment is the pump housing (16) (FIG. 3).

The sealing between pump housing (16) and both pump base (12) and pump head (19) is achieved by specialized threads such as API or Hydril threads providing metal on metal sealing, utilizing a large torque shoulder to permit high torque make-up to ensure strong connection, maximize material cross section resisting burst. The connection is designed to withstand multiple make-ups and breaks without requiring redress.

Sealing between piping and the pump discharge is by using ring or gasket type sealing and API type flanges (11) (FIG. 2).

The multistage centrifugal pump can be built as a single pump (low TDH) or as a multi-section pump (high TDH) (FIG. 4), depending on required Total Dynamic Head (TDH). In the multi-section design, pumps sections (45, 46) are connected in series on common pump bed (9) and their shafts are mechanically connected to be driven by common driver (42). The thrust generated in the pump is contained by Thrust Bearing Assembly (43). Pump intake (44) and discharge (47) complete the assembly.

The design modifications discussed herein have been successfully tested at a 10,000 psi discharge pressure. The 10,000 psi pressure capability provides a pressure suitable for fracturing formations penetrated by wellbores.

As many changes therefore may be made to the preferred embodiment of the invention without departing from the scope thereof. It is considered that all matter contained herein be considered illustrative of the invention and not in a limiting sense.

The invention claimed is:

1. A multiple stage centrifugal pump for fracturing hydrocarbon deposits comprising;

a pump housing for primary pressure containment, a housing seal located between a pump base and a pump head, and being a metal on metal type seal utilizing threads, diffusers having openings to allow rapid pressure equalization across a diffuser outside edge to avoid failure from high differential pressure, each said diffuser having a seal located on an outside of each of the diffusers to prevent pressure communication and fluid flow between the outsides of the individual diffusers enclosed within the housing, wherein pump connections for pump intake and discharge include ring or gasket sealing, and wherein said pump delivers the discharge pressure or differential pressure between the pump internal and external pressure of up to substantially 10,000 psi or over.

2. The multistage centrifugal pump of claim 1 further comprising impellors and a shaft, inserted within said housing, wherein the diffusers, impellors, and shaft comprise an assembly enclosed within the housing, and the housing being of sufficient strength for safe pressure containment of fluids being pumped.

3. The pump of claim 2 further including a pressure sleeve located on top of a diffuser wall of said diffusers for improved wall strength, therby creating a compression fit formed between the sleeve and an outside diameter of the diffuser wall.

4. The pump of claim 1 or 3 further including: equalization openings formed in the diffuser wall, resulting in zero differential pressure across the diffuser wall which also allows for rapid depressurizing.

5. The pump of claim 4 wherein to prevent stages from collapsing due to pressure transfer from one pump stage to another, an o-ring style seal is utilized between each diffuser and said housing.

6. The pump of claim 1 wherein sealing between the pump housing and both the pump base and the pump head is by said metal on metal threads providing metal on metal sealing.

7. The pump of claim 1 further comprising:

equalization openings formed in the diffuser wall, resulting in substantially zero differential pressure across said diffuser wall thereby providing for rapid depressurizing.

8. The pump of claim 7 further comprising:

o-ring sealing located between each diffuser and said housing to prevent stages from collapsing due to pressure transfer from one pump stage to another.

9. A multistage centrifugal pump assembly comprising:

diffusers, impellers, and a shaft, inserted within a high pressure housing, said assembly being fully enclosed within the housing, and the housing being of sufficient strength for pressure containment of fluids being pumped and to enable increase of discharge pressure capabilities to greater than 6,000 psi discharge pressure thereby providing pressures suitable for fracturing formations penetrated by wellbores.

10. The pump of claim 9 wherein:

said centrifugal pump, operates at speeds of substantially 30 to 90 hz, (1800 to 5400 rpm), with discharge pressures of about 10,000 psi, and with a suction pressure of about 15-600 psi.

11. The pump of claim 10 further comprising:

a pressure sleeve located on top of a diffuser wall of said diffusers for improved wall strength creating a compression fit formed between the sleeve and an outside diameter of the diffuser wall.

12. The pump of claim 11 wherein:

sealing between said pump housing and said pump base, and between said pump head, includes threads providing metal on metal sealing.

* * * * *